United States Patent [19]

Shimoyama et al.

[11] Patent Number: 4,506,494

[45] Date of Patent: Mar. 26, 1985

[54] PACKED BAG CUTTER

[76] Inventors: Mamoru Shimoyama, 399-1, Kami-Kobayashi; Isamu Hoshina, 1467-7, Nanjai, both of Tomioka, Gunma-ken, Japan

[21] Appl. No.: 486,100

[22] Filed: Apr. 18, 1983

[51] Int. Cl.[3] ..... B65B 9/12; B65B 51/14; B65B 51/32

[52] U.S. Cl. ..... 53/551; 53/373

[58] Field of Search ..... 53/551, 552, 51, 373, 53/389

[56] References Cited

U.S. PATENT DOCUMENTS 3,149,447 9/1964 Dorr ..... 53/551

3,611,657 10/1971 Inoue et al. ..... 53/551 X 3,703,796 11/1972 Inoue et al. ..... 53/551 X 3,738,080 6/1973 Reil ..... 53/551

4,127,976 12/1978 Jablonski et al. ..... 53/551 X

*Primary Examiner*—Horace M. Culver

*Attorney, Agent, or Firm*—McGlew and Tuttle

[57] ABSTRACT

A cutter is provided with a pair of squeezing rolls which is oppositely located and horizontally movable, and a pair of heat sealing means which is oppositely located under the squeezing rolls at a distance necessary for heat sealing and horizontally movable. A cutting means is provided immediately underneath the heat sealing means at a distance equivalent to the width of a sealed portion. The pair of squeezing rolls is provided with a means to intermittently rotate the rolls to move a packed bag.

1 Claim, 9 Drawing Figures

PACKED BAG CUTTER

BACKGROUND OF THE INVENTION (1) Field of the Invention

The present invention relates to a cutter of packed bags for use when packing a constant amount of a charge continuously in bags made of cylindrical resin film.

(2) Description of the Prior Art

A conventional cutter of packed bags made of cylindrical resin film and its operating procedure will be described with reference to FIGS. 3(A), (B), (C) and (D).

Generally cylindrical film 1 packed with a charge 2 is sealed by a sealing device 4, 4 at a sealing position as shown in FIG. 3(A). To the film under the sealing position 6 is attached a packed bag 1*a* which has previously formed. To the cylindrical resin film above the sealing position 6 is supplied a charge 2 in a constant amount. A pair of squeezing rolls are arranged above a sealing device consisting of a pair of sealing members 4,4 and located at such a position as to permit the forming of a packed bag. As shown in FIG. 3(B), the squeezing rolls 3,3 are moved to approach each other to press and divide the cylindrical film 1 filled with the charge 2 in a length necessary for one packed bag. Next the squeezing rolls 3,3 are rotated in the direction of the arrow marks to push the packed bag 1*b* downward under the heat-sealing device 4,4. Then the heat-sealing device 4,4 is in a position shown by the dotted lines, and moves in the direction indicated by the arrow marks and seals the film 1 at the position of real lines after the packed bag has moved downward. On the other hand, a cutting device or a cutter made of a pair of members is arranged in a position opposite to the sealed portion 6 at the bottom end of the packed bag, and the pair of members move toward each other to cut off the previously formed packed bag at the sealing portion 6. Thereafter the squeezing rolls 3,3 and the members of the heat-sealing device 4,4 both are respectively separated from each other, and the charge 2 is supplied into the cylindrical film 1, the bag packing operation being performed continuously by the same procedure.

The problems described hereunder arise in the use of the packing machine described above.

In the handling of a hot charge, the sealed portion 6 may be torn apart due to insufficient cooling when a hot charge 2 flows into the film 1 in the steps FIGS. 3(A) and (D), causing loss of the charge and the film. Further, although in FIG. 3(C) the distance $L_2$ between the squeezing rolls 3,3 and the sealing device 4 and the distance $L_1$ between the sealing device 4 and the cutter 5 are arranged so as to permit cutting of the film at the sealed portion 6, the cutting could occur, however, at the position of the sealed portion 6, thereby causing loss of the charge 2 and the film 1 and contamination of the environment of the machine, leading to reduced working efficiency, because in the actual operation the length of each one of the packed bags 1*a*, 1*b* is not necessarily constant due to variation of conditions of charge, e.g. temperature etc., or the like.

BRIEF SUMMARY OF THE INVENTION

The objective of the present invention is to eliminate the problems existing in machines of prior art and to provide a novel packed bag cutter comprising a pair of squeezing rolls which is provided in the upper part thereof, a pair of sealing means which is arranged in the lower portion thereof at a distance equivalent to the length of a packing bag from the pair of squeezing rolls, and a pair of cutting means which is provided underneath and adjacent to the sealing means, wherein the pairs of squeezing rolls, sealing means and cutting means are respectively located oppositely and movable horizontally, characterized in that the pair of squeezing rolls is provided with an intermittent rotating means which displaces the sealed portion of the packed bag from the sealing position accurately to the position of the cutting means located under the sealing position, thereby ensuring the cutting of the sealed portion, and also strengthening the seal by cooling the sealed portion with the cutting means, securing sealing of packed bags.

DETAILED DESCRIPTION OF THE INVENTION

Figure 1:
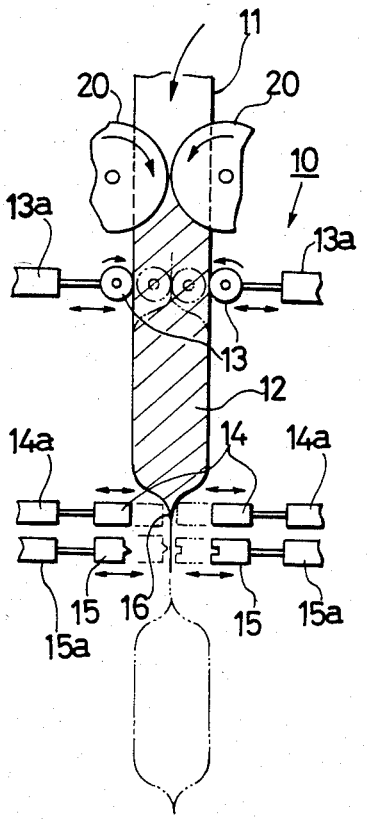
FIG. 1 is a side view illustrating a cutter of the invention.

According to the present invention, a packed bag cutter comprises a pair of squeezing rolls which is located oppositely in its upper part and movable horizontally in the opposite direction, a pair of heat-sealing means which is located oppositely under the squeezing rolls at a distance necessary for heat-sealing of a bag and movable horizontally in the opposite direction, and a pair of cutting means which is oppositely located immediately underneath the heat-sealing means at a distance equivalent to the width of the heat seal and movable horizontally in the opposite direction, characterized in that the pair of squeezing rolls is provided with an intermittent roll-rotating means which rotates the rolls in their closed position and displaces the film downward for a length equivalent to one packed bag, thereafter stops the film motion to have heat sealing performed and then moves the film downward for the width of the seal.

The present invention will now be described using an example with reference to the accompanying drawings.

A cutter according to the invention comprises feeding rollers 20,20 to feed cylindrical film 11, squeezing rolls 13,13 which are located under the rollers 20,20 which rotate synchronously with the rollers 20,20, a heat sealing means 14,14 which is located under the squeezing rolls 13,13 at a distance necessary for heat sealing of a bag, and a cutting means which is located under the heat sealing means 14,14 at a distance nearly equal to the width of the sealed portion 16. The squeezing rolls 13,13, heat sealing means 14,14 and cutting means 15,15 are respectively provided with driving means 13*a*, 14*a* and 15*a* such as actuating cylinders for horizontally moving their respective pairs toward or away from each other. A timing means (not shown) is provided to operate the heat sealing means after the squeezing rolls 13,13 divide the charge 12 in the film 11 and rotate in closed position to feed the film for a predetermined length. Furthermore, a means (not shown) is provided to intermittently drive the squeezing rolls 13,13 so that it rotates the rolls 13,13 to move the sealed portion 16 downward for its width while the heat sealing means is opening after completing heat-sealing operation and stops the rolls 13,13 while cutting the sealed portion 16. This means may be either automatic, with a timer or the like, or manual.

Now the operation will be described of cutting packed bags with the cutter according to the invention, with reference to FIGS. 2(A), (B), (C) and (D).

Figure 2A:
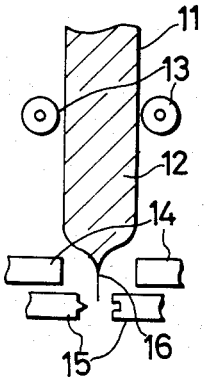
FIGS. 2(A), (B), (C) and (D) are schematic views of the packed bag cutter of FIG. 1, showing the operational steps of the device of the invention, and FIGS. 3(A), (B), (C) and (D) are schematic views of a packed bag cutter of prior art using cylindrical resin film and its operation.
Figure 2B:
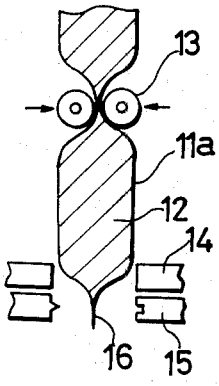
Figure 2C:
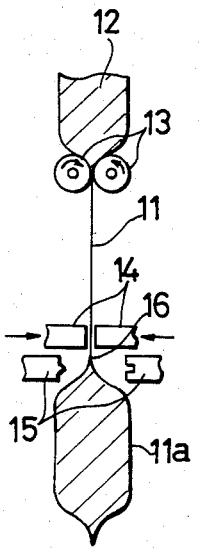
Figure 2D:
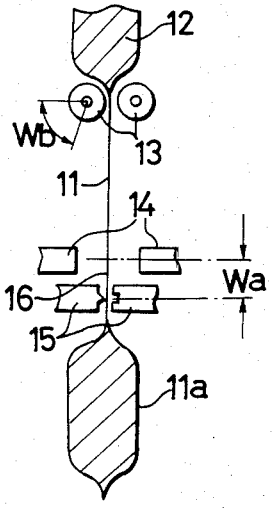
Figure 3A:
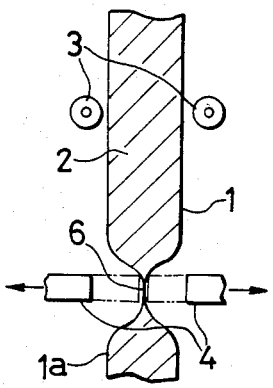
Figure 3B:
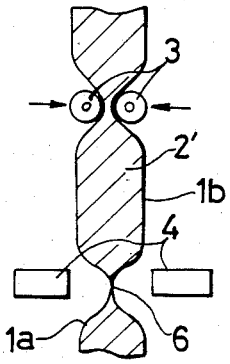
Figure 3C:
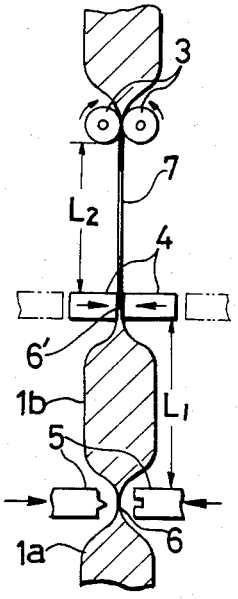
Figure 3D:
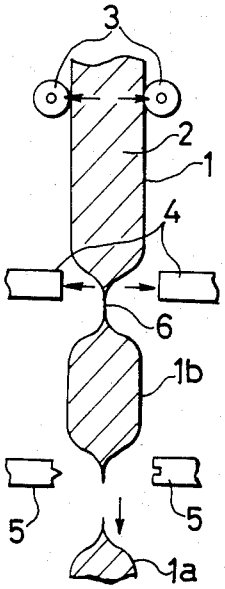

In FIG. 2(A) is shown the condition in which cutting is completed after heat sealing, where the squeezing rolls are separated open to fill the film 11 with the charge 12 to its bottom. Generally the charge 12 may be in the form of a liquid, semiliquid or paste. FIG. 2(B) shows the condition in which the squeezing rolls 13,13 are closed to divide the charge 12 and enclose a bagful of charge in the packed bag 11*a*, the heat sealing means 14,14 and the cutting means 15,15 both being in an open condition then. In the condition shown in FIG. 2(C), the squeezing rolls 13,13 rotate in closed position to move the film 11 downward in the flattened form, the downward movement stops when the packed bag 11*a* reaches the position underneath the heat sealing means 14,14, and the heat sealing means 14,14 closes to heat-seal the film 11 at the sealed portion 16. Thereafter, as shown in FIG. 2(D), the squeezing rolls 13,13 momentarily rotate for a circumferential length Wb to move the film 11 downward for a length Wa. The length Wa is equivalent to the width of the heat sealed portion 16. Naturally the lengths Wa and Wb are almost the same. When the packed bag 11*a* moves downward and the sealed portion 16 stops at the position between the members of the cutting means 15,15, the cutting means 15,15 closes to cut the sealed portion off. Since the cutting means 15,15 contacts the sealed portion of the film at this time, the sealed portion 16 is cooled to ensure strengthening of the seal. The sealed portion 16 is cut off after a slight movement away from the sealing position; therefore the location being cut should be determined accurately enough to avoid cutting at a position of the sealed portion 16. Thereafter, the cutting means 15,15 opens up and the squeezing rolls 13,13 separate, the film 11 being filled with the charge 12 as shown in FIG. 2(A). Since the sealed portion 16 is cooled by the cutting means 115 when cutting is done to ensure stengthening of the seal, it is quite unlikely that the seals would be torn apart due to high temperature of the charge 12 if any. Moreover, since only one packed bag 11*a* is attached to the lower end of the sealed portion when heat sealing is done and before cutting is done as shown in FIGS. 2(C) and (D), it is not possible for the sealed portion to break due to the weight of the charge. In the prior art, however, the weight of two bagfuls of charge is carried by the sealed portion 6 as shown in FIG. 3(C), therefore it is possible that the sealed portion would break. The arrangement of the present invention makes the seal stronger at the same time as cutting is done after sealing is ensured, so it is possible to prevent the charge from being included in the sealed portion and rotting.

What is claimed is:

1. A packaging machine for intermittently feeding a tubular film material, filling it with a substance to be packaged and sub-dividing it into individual packages, which machine comprises:

(a) a pair of pinching rolls positioned opposite each other in the upper region of said machine and movable perpendicularly toward and away from said tubular film;

(b) a pair of heat-sealing means positioned opposite each other, substantially spaced from and beneath said pinching rolls and movable perpendicularly toward and away from said tubular film;

(c) a pair of cooling-cutting means positioned opposite each other, spaced from and beneath said heat-sealing means at a distance corresponding to the width of a sealed portion of tubular film and movable perpendicularly toward and away from said tubular film; and (d) means for rotatingly driving said pinching rolls alternately, first a distance corresponding to the positioning of said tubular film in juxtaposition with said heat-sealing means, and then a distance corresponding to the width of the sealed portion of said tubular film.

* * * * *